US006598824B2

(12) United States Patent
Schmidt

(10) Patent No.: US 6,598,824 B2
(45) Date of Patent: Jul. 29, 2003

(54) ELECTRICAL AND MECHANICAL COIL SYSTEM FOR DUAL AND SINGLE ACTION SOLENOIDS

(75) Inventor: Stephen M. Schmidt, Menomonee Falls, WI (US)

(73) Assignee: Trombetta, LLC, Menomonee Falls, WI (US)

( * ) Notice: Subject to any disclaimer, the term of this patent is extended or adjusted under 35 U.S.C. 154(b) by 0 days.

(21) Appl. No.: 09/991,520

(22) Filed: Nov. 20, 2001

(65) Prior Publication Data

US 2003/0094535 A1 May 22, 2003

(51) Int. Cl.[7] ..... B65H 75/14

(52) U.S. Cl. ..... 242/603; 242/587.2; 242/118.41

(58) Field of Search ..... 242/603, 605, 242/608.6, 608.7, 609.3, 614, 118.4, 125.1, 587.2, 474.9, 475, 476.1

(56) References Cited

U.S. PATENT DOCUMENTS

| | | | | |
|---|---|---|---|---|
| 810,490 A | * | 1/1906 | Knupp et al. | 242/603 |
| 1,944,582 A | | 1/1934 | Snyder | |
| 2,212,798 A | * | 8/1940 | Sole | 242/603 |
| 2,271,326 A | * | 1/1942 | Bird | 242/614 |
| 2,355,477 A | | 8/1944 | Stahl | |
| 2,787,743 A | | 4/1957 | Hultgren | |
| 3,083,930 A | | 4/1963 | Brekke | |
| 3,185,948 A | | 5/1965 | Helberg | |
| 3,308,412 A | | 3/1967 | Curtis et al. | |
| 3,457,534 A | | 7/1969 | Davis | |
| 3,605,055 A | | 9/1971 | Grady | |
| 3,606,195 A | | 9/1971 | Freeman, Jr. et al. | |
| 3,661,342 A | | 5/1972 | Sears | |
| RE27,891 E | | 1/1974 | Davis | |
| 4,274,136 A | * | 6/1981 | Onodera et al. | 363/68 |
| 4,363,014 A | | 12/1982 | Leach et al. | |
| 4,462,016 A | * | 7/1984 | Bland et al. | 242/118.41 X |
| 4,739,945 A | * | 4/1988 | Yokoe | 242/118.41 |
| 5,600,294 A | | 2/1997 | Buenconsejo et al. | |
| 5,774,036 A | | 6/1998 | Hrytzak et al. | |
| 6,031,443 A | | 2/2000 | Larsen | |
| 6,073,869 A | | 6/2000 | Schulz | |

FOREIGN PATENT DOCUMENTS

| | | |
|---|---|---|
| JP | 55-36973 | 3/1980 |

* cited by examiner

*Primary Examiner*—William A. Rivera
(74) *Attorney, Agent, or Firm*—Ryan Kromholz & Manion, S.C.

(57) ABSTRACT

A coil bobbin structure comprising a series of axially spaced bobbin members including integrally formed tubular base portions supported on a tubular support member. The base portions each have edges facing one another and including stepped edged portions cooperating to provide interlocking structure for resisting relative rotation of the bobbin members and the tubular support member. The bobbin members each include radially extending flanges arranged to receive entering and exiting coil lead wires and to route the lead wires along a longitudinal path extending across a coil wound on the structure.

30 Claims, 4 Drawing Sheets

Fig. 2
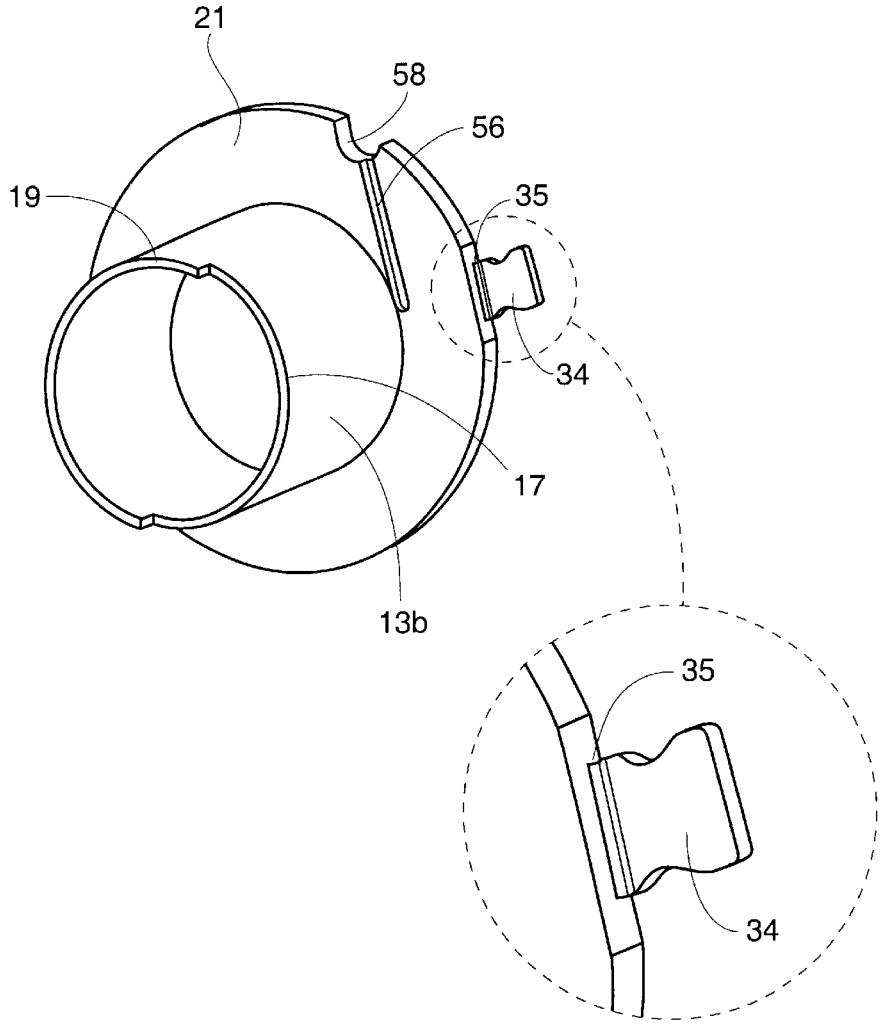
Fig. 2a
Fig. 3
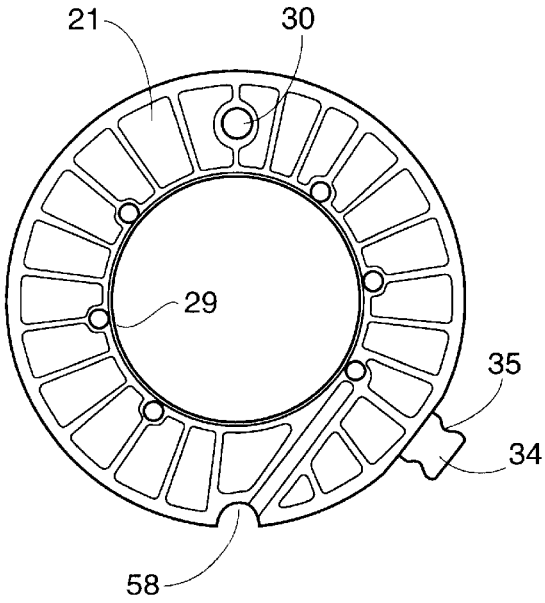

ELECTRICAL AND MECHANICAL COIL SYSTEM FOR DUAL AND SINGLE ACTION SOLENOIDS

BACKGROUND OF THE INVENTION

The winding of electrical coils for such devices as transformers, solenoids, inductors, relays and other units have become very highly developed and in many cases have been automated. The production quantities of units utilizing electrical winding of this type run into the millions of units per year on many types and sizes of devices. Obviously, any savings that can be accomplished in the production in this tremendous number of units constitutes a substantial savings on an over-all basis for each year.

Electrical coils wound on winding forms or bobbins has been known and used extensively for many years. In order to make bobbin wound coils from a cost standpoint, it has become necessary to provide an arrangement for leading the initial wire from the center of the bobbin or the winding portion of the form, to an external point or terminal. In the past, expedients such as holes either drilled or formed through the flange of the winding form or bobbin have been utilized. This arrangement has not been satisfactory in that it takes a considerable amount of manual dexterity and time to feed a small wire through such a hole in the beginning of the operation of winding a bobbin. This is especially true in the case of axially spaced bobbins used in supporting separate coils such as the pull coil and push coil used on dual operated solenoids were positive action is sought and controlled by alternatively passing current through the individually wound coils positioned on a supporting sleeve passing through a central opening in each of the spaced-apart wound coil units.

Also in the past, there have been concerns with coaxially spaced bobbins tending to rotate relative to one another, particularly when supported by a tubular sleeve having a circular cross section.

SUMMARY OF THE INVENTION

It is an object of the present invention to provide a bobbin type dual winding form that allows all lead lines to lead to and emerge from a single end, particularly when two coils are wound at the same time.

Another feature of the present invention lies in the fact that all parts are interlocked, providing anti-rotation throughout the assembly. The present invention includes magnetic washers positioned between coaxially spaced coils and bobbins, and wherein the washers include apertures and mating protrusions for interlocking arrangement. The interlocking arrangement allows the anti-rotation feature to carry throughout the solenoid assembly. Furthermore, stepped tube ends on inter-fitting bobbin components, and semi-perforated nibs in the magnetic steel spool washers positioned between the coils provide further inter-fitting arrangements.

An improved end cover has been provided for convenience in handling a coiled assembly prior to insertion into a main assembly, and which further protects the lead lines from damage. The end cover is provided with inter-fitting fins, which act in unison with the mating end pieces to further provide improved dielectric insulation.

The present invention further provides a solution to the problem of damage to insulation resulting from cutting and rubbing against burrs and other sharp edges. The solution incorporates a built-in plastic lead wire grommet as part of the bobbin assembly. The grommet provides electrical and mechanical protection of the lead wires, and provides an anti-rotational interlock between the coil assembly and the housing assembly.

The present invention combines several existing solenoid technologies in a unique combination, and further includes several new components.

Presently, solenoid bobbins have been made using rather large individual pieces. The present invention seeks to utilize more numerous, inter-fitting smaller pieces (a number of these being identical in configuration) to decrease the overall cost of manufacture, and thereby incorporate several unique elements to simplify bobbin assembly techniques and also to overcome past shortcoming. The use of inter-fitting segments allows creating a multitude of configurations, by intermixing different segments. This is an attractive means of achieving coil length variations that are common for applications with diverse stroke requirements. Many variations can be generated without the need to retool the most complex and expensive component, the flange with the lead finish labyrinth (discussed infra).

Present manufacture of solenoids requires attaching lead wires to each winding in its own winding space. Usually, lead splicing and holddown is done directly over the magnet wire winding. This procedure requires careful and time-consuming insulation to avoid dielectric breakdown between the splice and the underlying magnet wire. Individual spool assemblies with lead-finish labyrinths on each end may be used in the dual action (two coil) solenoid configuration, as they are now commonly used in single action (one coil) solenoids. The drawback is that, after assembly, the leads are located at each end of the coil. It is necessary to fold one pair of lead lines to an opposite, exit end for assembly into the housing. This is cumbersome and time consuming.

The present invention allows all lead lines to lead to and emerge from a single end. This feature presents a more convenient assembly of components. In the present invention, two coils may be wound at the same time. The start of the first coil is tied to a winding mandrel while the start of a second coil is tied to a molded tab in a bobbin piece. The start of the second coil is also located by a slot in the flange that routes the wire to the lead attachment piece.

As discussed above, another feature of the present invention is that all parts of the present bobbin assembly are interlocked, providing anti-rotation throughout the assembly. In the past, various means including pressed-on washers have been used. The present invention includes washers having protrusions for interlocking arrangement. The interlocking arrangement allows the anti-rotation feature to carry from the housing throughout the entire solenoid assembly. Furthermore, stepped tube ends fit into each other, while semi-perforated nibs in the steel spool washers will allow further inter-fitting arrangements.

The present invention also provides for a unique end cover. The end cover provides convenience in handling the coiled assembly prior to insertion into the main assembly, and further protects the lead lines from damage. The end cover is provided with inter-fitting fins, which act in unison with the mating end piece to further provide improved dielectric insulation.

BRIEF DESCRIPTION OF THE DRAWINGS

FIG. 2 is an isometric view of a half-bobbin member used in the assembly shown in FIG. 1.

FIG. 2*a* is an enlarged fragmentary portion of the half-bobbin member.

FIG. 3 is an end view of the flange portion of the half-bottom member of FIG. 2.

DESCRIPTION OF THE PREFERRED EMBODIMENT

Figure 1:
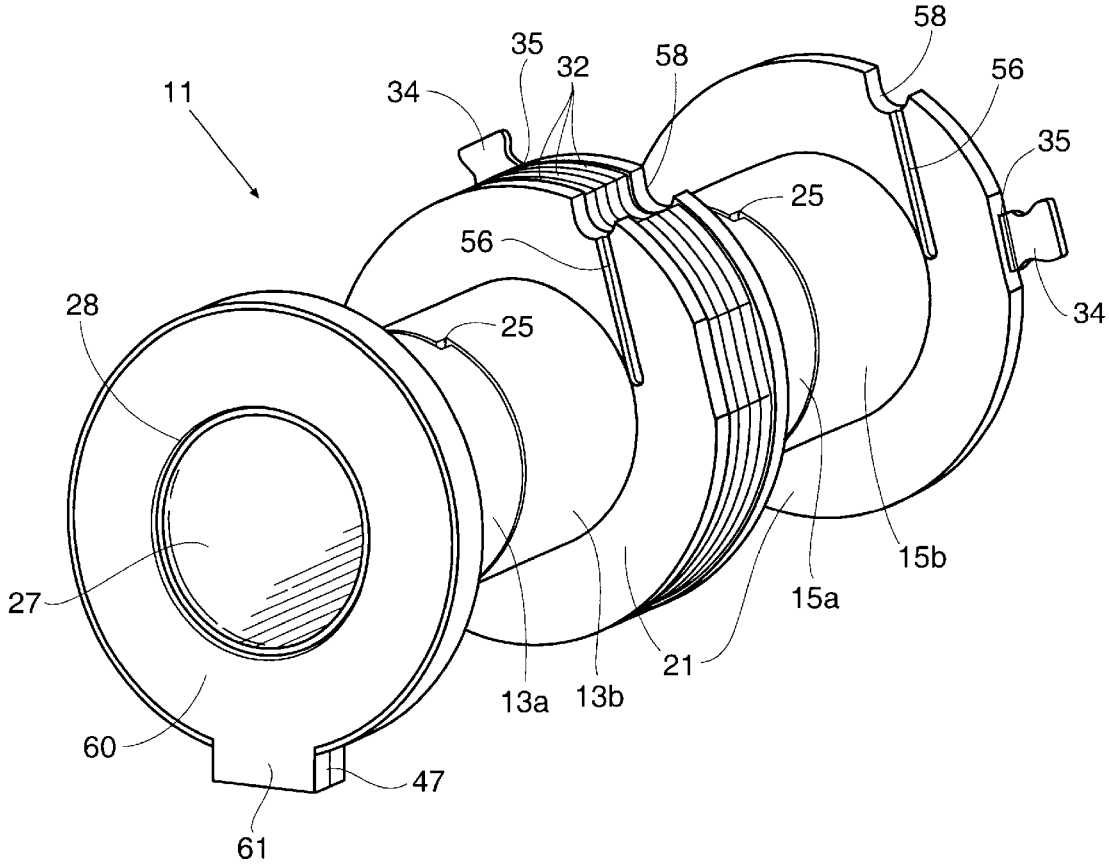
FIG. 1 is an isometric view of a dual coil bobbin assembly, prior to coil winding, of the present invention.

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

It is to be understood that like parts hereinafter described are identified by like reference characters.

Figure 4:
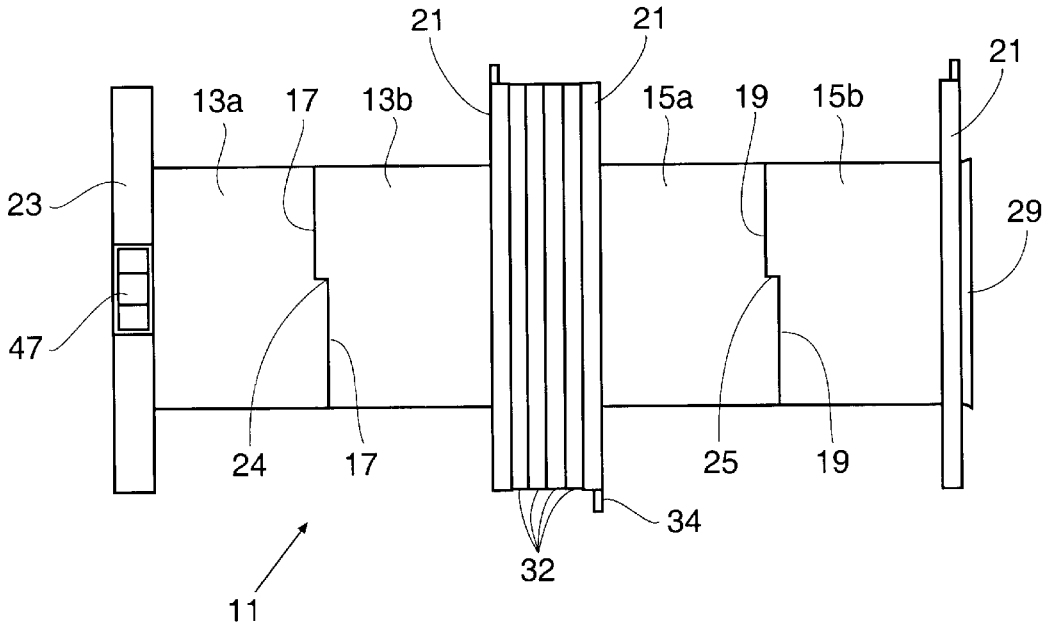
FIG. 4 is a plan view of the inter-fitting components of the dual coil assembly of FIG. 1.
Figure 5:
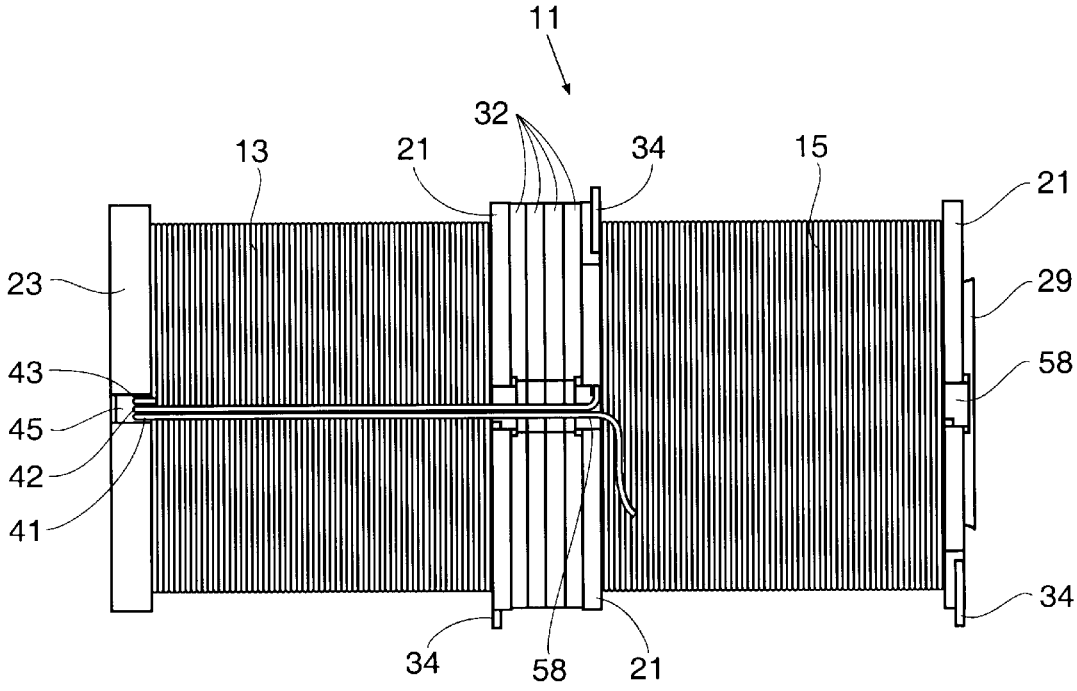
FIG. 5 is a plan view of the final coil members of the dual coil assembly utilizing the bobbin assembly of FIG. 1.

With reference to FIGS. 1, 4 and 5, it will be observed that the present invention has particular application to a bobbin wound coil for a dual action solenoid, indicated generally by the reference character 11, as shown in the view of FIG. 5, the finished wound coil assembly includes a push coil 13 and a pull coil 15, each of which coils may be simultaneously wound on a single winding mandrel (not shown).

The coil assembly 11 includes a winding base of three identical half-bobbin members 13*b*, 15*a* and 15*b*. Half-bobbin members 13*a* and 13*b* include stepped mating edges 17. Half-bobbin members 15*a* and 15*b* include stepped mating edges 19. Half-bobbin member 13*a* includes a slightly different configuration than members 13*b*, 15*a* and 15*b*, as will be later discussed herein. For the present, however, each of the half-bobbin members 13*b* and 15*a*, 15*b* have an integrally molded, substantially identical, radially extending flange portion 21, whereas the integrally molded flange portion 23 of half-bobbin member 13*a* provides an outward facing labyrinth surface for the half-bobbin 13*a* , as shown in detail in FIG. 6.

The invention further contemplates configuring the mating edges 17 and 19 with a stepped surface on each of the facing half-bobbin members 13*a*, 13*b* and 15*a*, 15*b* to form inter-locking junctions 24 and 25, respectively. Each of the coils 13 and 15 with their half-bobbin members 13*a* and 13*b*, and 15*a* and 15*b* are positioned on a brass (non-magnetic), tubular spool member 27 having outwardly flared ends 28 and 29, respectively.

Positioned between the coils 13 and 15 are one or more steel (magnetic) washers 32, which are also seated on the non-magnetic tube 27. Each of the washers 32, as well as the facing flanges 21, are provided with anti-rotational means, such as the aperture 30 (see FIG. 3) and a dimple or protuberance (not shown) located on an adjacent washer 32, which interfit with one another.

With reference to FIGS. 2 and 2*a*, the flanges 21 are each additionally provided with integrally molded tabs 34, which are provided with a frangible area 35 permitting the unused portion to be snapped off by hand, as needed.

Figure 6:
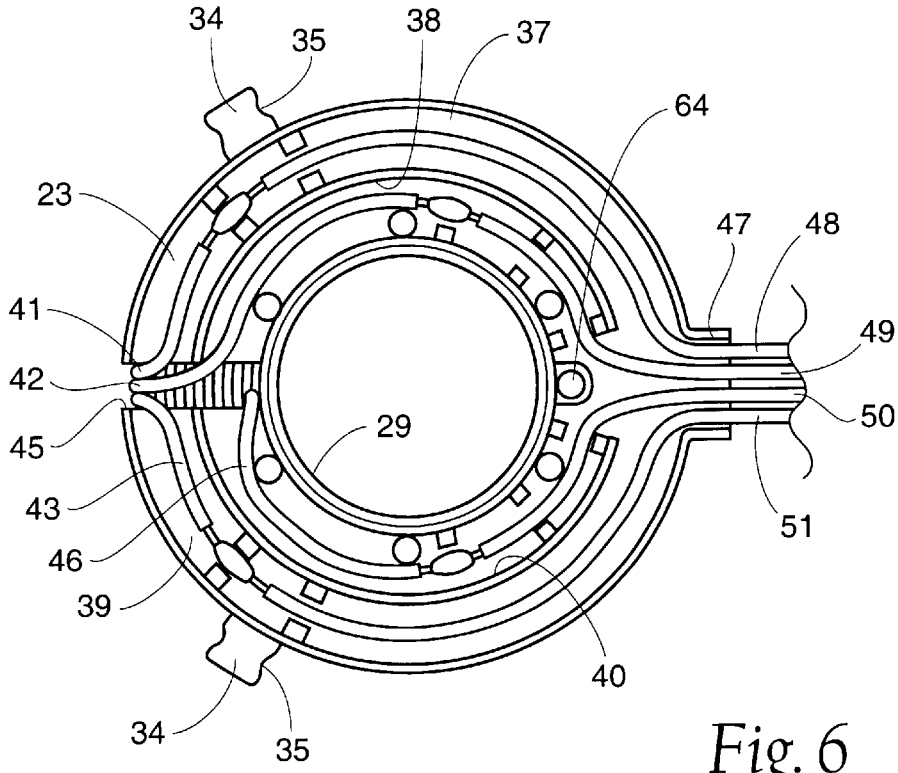
FIG. 6 is an end view of the assembly illustrated in FIG. 5, and showing the labyrinth construction for retaining and routing lead wires of the finished coil assembly of FIG. 5.

As will be observed from FIG. 6, the end flange 23, molded integrally with the half-bobbin 13*a*, includes a labyrinth of arcuate channels or grooves 37, 38, 39 and 40 for guiding and retaining incoming leads 41, 42, and 43, respectively. The incoming leads 41, 42, and 43 reside in a notch 45 formed in the circumference of the flange 23. Diametrically opposed to the notch 45 is an integrally formed rectangular grommet 47 which acts to retain the exiting leads 48, 49, 50, and 51 joined to the magnet coil wires 41, 42, 46, and 43, respectively. Each of the flanges 21 are identically molded, the flanges 21 contain a slot 56, which is molded substantially tangential to the circumference of the tubular spool 27. The slot 56 in the flange 21 of the half-bottom member 15*a* (see FIG. 2) supports and routes the inner most magnet coil wire (not shown) for winding the coils 13 and 15, respectively. A notch 58 is provided in the flanges 21 for supporting the entry end of a magnet coil lead routed through the groove 56.

As illustrated in FIGS. 5 and 6, the wound end leads 41 and 42 may be guided through the notches 58 of the flanges 21 and washers 32 to lie longitudinally across the wound coil 13 to enter the labyrinth of flange 23 via the notch 45.

Figure 7:
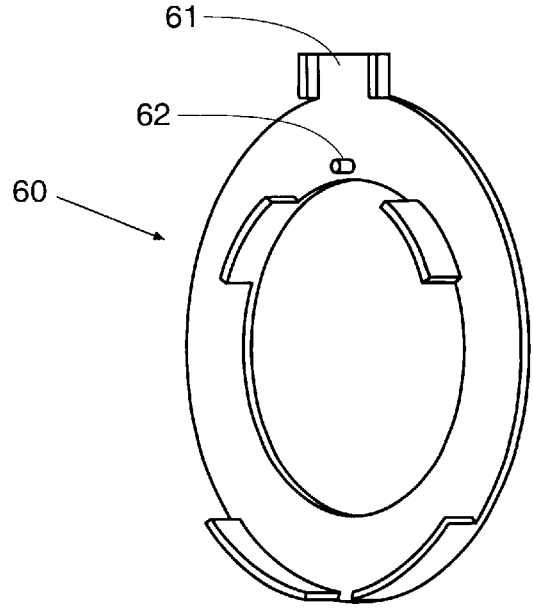
FIG. 7 is an isometric view of a bobbin cover.

With reference to FIGS. 1 and 7, a cover 60 is provided for added protection of the leads contained in the rectangular grommet 47 of the flange 23 and in the well of the flange 23. The cover 60 also has a post 62 (see FIG. 7) that press fits into recess 64 shown in FIG. 6. This holds the cover 60 in place until an adhesive or sealant selectively placed in arcuate channels 37 can cure. An orientation tongue 61 has the same dimensions as the interior of the grommet 47, and is seated therein.

The adhesive/sealant is applied in the areas where the magnet wires are joined to the stranded lead wires. This adhesive, when cured, provides mechanical resistance to vibration, and improved electrical insulation.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A coil bobbin comprising:

a tubular support member;

a pair of coaxial spaced coil bobbins and at least one coaxially spaced metallic washer located between each of said bobbins, each of said bobbins and said metallic washer being circumferentially supported by said tubular support member;

one of said bobbins comprising a first bobbin members, said bobbin members further including a radially extending flange portion, the flange portion of said first bobbin members being seated adjacent said washer, said flange portion and said washer including interlocking means preventing relative rotation of said flange portion and said washer;

the other of said bobbins including a second bobbin member, and wherein a flange of said other bobbin member has an outer surface facing said washer and is in non-rotational relationship therewith, and a radial channel being formed in said flange for directing a coil winding lead wire outwardly from said coil bobbin structure.

2. The coil bobbin structure of claim 1 wherein each of the flange portions of the bobbin members includes an angular slot substantially tangential to the tubular support member and arranged to receive and route the coil winding lead wire in a preferred direction away from the tubular support member.

3. The coil bobbin structure of claim 1 wherein each of the flange portions of the bobbin members includes circumferentially spaced, radially extending, break-away tabs arranged for temporarily retaining the starting end portion of the coil winding lead wire.

4. The coil bobbin member of claim 1 wherein each bobbin member further includes a stepped surface on an end opposite said flange portion.

5. The coil bobbin structure of claim 1 wherein each of the washers are made of magnetic material.

6. The coil bobbin structure of claim 1 wherein the tubular support member is made of nonmagnetic material.

7. The coil bobbin structure of claim 1 wherein the flange portion of at least one of said bobbin members includes an outwardly facing surface defining a labyrinth of radially spaced grooves for respectively receiving an ending lead wire of said coil member.

8. The coil bobbin structure of claim 7 wherein said flange portion further includes a peripheral entrance notch communicating with one end of said radially spaced grooves and a peripheral, radially extending exit grommet communicating with an opposite end of said radially spaced grooves.

9. The coil bobbin structure of claim 7 wherein said flange portion includes a protective cover plate.

10. The coil bobbin structure of claim 7 wherein said flange portion includes a protective cover plate having a mating configuration.

11. A coil bobbin structure comprising:

a tubular support member;

a pair of first and second coaxially spaced coil bobbin members and at least one coaxially spaced metallic washer located between each of said first and second bobbin members, each of said bobbin members and said metallic washer being circumferentially supported by said tubular support member;

said first bobbin members including a radially extending flange portion, the flange portion being seated adjacent said washer, said flange portion and washer including interlocking means preventing relative rotation of said flange portion and said washer;

a flange of said second bobbin member having an outer surface facing said washer and being in non-rotational relationship therewith, and a radial channel being formed in said flange for directing a coil winding lead wire outwardly from said coil bobbin structure.

12. The coil bobbin structure of claim 11 wherein at least one of the flange portions of the bobbin members includes an angular slot substantially tangential to the tubular support member and arranged to receive and route the coil winding lead wire in a preferred direction away from the tubular support member.

13. The coil bobbin structure of claim 11 wherein at least one of the flange portions of the bobbin members includes circumferentially spaced, radially extending, break-away tabs arranged for temporarily retaining the starting end portion of the coil winding lead wire.

14. The coil bobbin member of claim 11 wherein each bobbin member comprises a pair of bobbin members and further includes a stepped surface on an end opposite said flange portion.

15. The coil bobbin structure of claim 11 wherein each of the washers are made of magnetic material.

16. The coil bobbin structure of claim 11 wherein the tubular support member is made of nonmagnetic material.

17. The coil bobbin structure of claim 11 wherein the flange portion of at least one of said bobbin members includes an outwardly facing surface defining a labyrinth of radially spaced grooves for respectively receiving an ending lead wire of said coil member.

18. The coil bobbin structure of claim 17 wherein said flange portion further includes a peripheral entrance notch communicating with one end of said radially spaced grooves and a peripheral, radially extending exit grommet communicating with an opposite end of said radially spaced grooves.

19. The coil bobbin structure of claim 17 wherein said flange portion includes a protective cover plate.

20. The coil bobbin structure of claim 17 wherein said flange portion includes a protective cover plate having a mating configuration.

21. A coil bobbin structure comprising:

a tubular support member;

a pair of coaxially spaced coil bobbins and at least one coaxially spaced metallic washers located between each of said bobbins, each of said bobbins and said metallic washer being circumferentially supported by said tubular support member;

a coil wound upon each of said coil bobbins and having a coil anchoring lead wire and an ending lead wire;

one of said bobbins comprising a first bobbin member, said bobbin member further including a radially extending flange portion, the flange portion being seated adjacent said washer, said flange portion and the washers including interlocking means preventing relative rotation of said flange portion and said washer;

the other of said bobbins including a second bobbin members, and wherein a flange of said second bobbin member has an outer surface facing said washer and is in non-rotational relationship therewith, and a radial channel being formed in said flange for directing a coil windings leads wire outwardly from said coil bobbin structure.

22. The coil bobbin structure of claim 21 wherein each of the flange portions of the bobbin members includes an angular slot substantially tangential to the tubular support member and arranged to receive and route the coil winding lead wire in a preferred direction away from the tubular support member.

23. The coil bobbin structure of claim 21 wherein each of the flange portions of the bobbin members includes circumferentially spaced, radially extending, breakaway tabs arranged for temporarily retaining the starting end portion of the coil winding lead wire.

24. The coil bobbin structure of claim 21 wherein each of the washers are made of magnetic material.

25. The coil bobbin structure of claim 21 wherein the tubular support member is made of nonmagnetic material.

26. The coil bobbin structure of claim 21 wherein each of the bobbin members have facing edges defining a stepped configuration and wherein the facing steps of respective bobbin members are interlocked with one another to resist relative rotational movement of the facing bobbin members and with the tubular support member.

27. The coil bobbin structure of claim 21 wherein the flange portion of at least one of said bobbin members includes an outwardly facing surface defining a labyrinth of radially spaced grooves for respectively receiving at least one of the ending lead wires of each of said coil bobbins.

28. The coil bobbin structure of claim 27 wherein said flange portion further includes a peripheral entrance notch communicating with one end of said radially spaced grooves and a peripheral, radially extending exit grommet communicating with opposite end of said radially spaced grooves.

29. The coil bobbin structure of claim 27 wherein said flange portion includes a protective cover plate.

30. The coil bobbin structure of claim 27 wherein said flange portion includes a protective cover plate having a mating configuration.

* * * * *